US006490753B1

(12) United States Patent
Chen

(10) Patent No.: US 6,490,753 B1
(45) Date of Patent: Dec. 10, 2002

(54) STEAM CLEANER

(75) Inventor: Shih-Yang Chen, Yung Kang (TW)

(73) Assignee: Fong Yen Electrical Co., Ltd., Tainan Hsien (TW)

( * ) Notice: Subject to any disclaimer, the term of this patent is extended or adjusted under 35 U.S.C. 154(b) by 0 days.

(21) Appl. No.: 09/939,612

(22) Filed: Aug. 28, 2001

(51) Int. Cl.[7] ..... B08B 3/00
(52) U.S. Cl. ..... 15/320; 15/344; 392/333
(58) Field of Search ..... 15/320, 344, 322; 392/333

(56) References Cited

U.S. PATENT DOCUMENTS 3,061,959 A * 11/1962 Blumenfeld ..... 15/320
4,369,544 A * 1/1983 Parisi ..... 15/320
5,386,612 A * 2/1995 Sham ..... 15/320
5,502,872 A * 4/1996 Chae et al. ..... 15/320
6,112,367 A * 9/2000 Burr et al. ..... 15/320
6,289,551 B1 * 9/2001 Basile ..... 15/320
6,311,365 B1 * 11/2001 Dornier ..... 15/302

* cited by examiner

*Primary Examiner*—Chris K. Moore
(74) *Attorney, Agent, or Firm*—Rosenberg, Klein & Lee

(57) ABSTRACT

A steam cleaner includes a housing, a head cleaning member fitted to an upper end opening of the housing, an electric heater received in the housing, a pump also received in the housing, and a water container secured to the bottom of the housing. The pump has an inlet connected to the water container, and an outlet connected to a water pipe passing through the electric heater. A nozzle is connected to the upper end of the water pipe. When the pump and the heater are activated, the pump forces the water in the container through the water pipe for allowing the water to be heated to become steam by the electric heater. The steam is sent out via both the nozzle and the head member to help kill bacteria when the head member is rubbed against an object in cleaning.

12 Claims, 9 Drawing Sheets

STEAM CLEANER

BACKGROUND OF THE INVENTION

The present invention relates to a steam cleaner, and more particularly, to a steam cleaner which takes the form of a combination of a steam producing equipment and an ordinary mop so as to be able to kill the bacteria when it is used for cleaning an object.

Mops are used for washing floors, cars etc, and consist of a long stick with threads of thick string or a piece of sponge. The threads of thick string and the sponge are soaked with water before the mops are used. However, the mops can only remove dirt from the floor or the car without killing the bacteria. To be able to kill the bacteria while cleaning, the mops have to be soaked with water, into which detergent is added. However, the detergent is likely to harm the user's hands and pollute the environment. Other cleaning equipments such as brushes for washing nets and screen windows have the same disadvantages.

SUMMARY OF THE INVENTION

Therefore, it is a main object of the present invention to provide a steam cleaner, which consists of a steam producing equipment and an ordinary cleaner so as to be able to kill the bacteria with the steam when the cleaner is rubbed against an object to remove the dirt.

It is another object of the present invention to provide the steam cleaner with a safety switch such that the steam producing equipment can automatically be cut off when overheats.

It is a third object of the present invention to provide a filter to the steam cleaner for removing the impurity of the water so as to prevent the impurity from blocking the nozzle.

It is a fourth object of the present invention to provide a removable extension holding rod to the steam cleaner for allowing the user to hold the cleaner in cleaning.

The steam cleaner of the present invention includes a housing member, an electric heater, a nozzle, a pump, a filtering member, a head cleaning member and a water container. The housing member has a handle, an upper end opening and a lower base part. The base part has a first and a second connecting holes, and a connecting part having a hole communicating with the first connecting hole.

The electric heater is positioned in the housing member, and electrically connected to a switch fitted on the housing member. The nozzle is connected to the upper end opening.

The pump is positioned in the housing member, and electrically connected to the switch. The pump has an inlet connected to the second connecting hole of the base part, and a water pipe is connected to an outlet of the pump. The water pipe is passed through the electric heater to communicate with the upper end opening.

The filtering member is secured to the base part, and has an inlet connected to the first connecting hole and an outlet connected to the second connecting hole. The head member is connected toe upper end opening of the housing, and can take various forms such as a round brush and the head of a mop to suit different needs.

The water container is secured to the connecting part from a top cap thereof. The cap has a hole for allowing water in the container to be forced through the cap hole, the hole of the connecting part, the inlet of the filtering member, the filtering member, the inlet of the pump, and the water pipe in sequence when the switch is pressed so as to activate the pump and the heater.

Thus, the water forced through the water pipe is heated to become steam by the heater and sent out via the head member to kill bacteria when the head member is rubbed against an object in cleaning.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
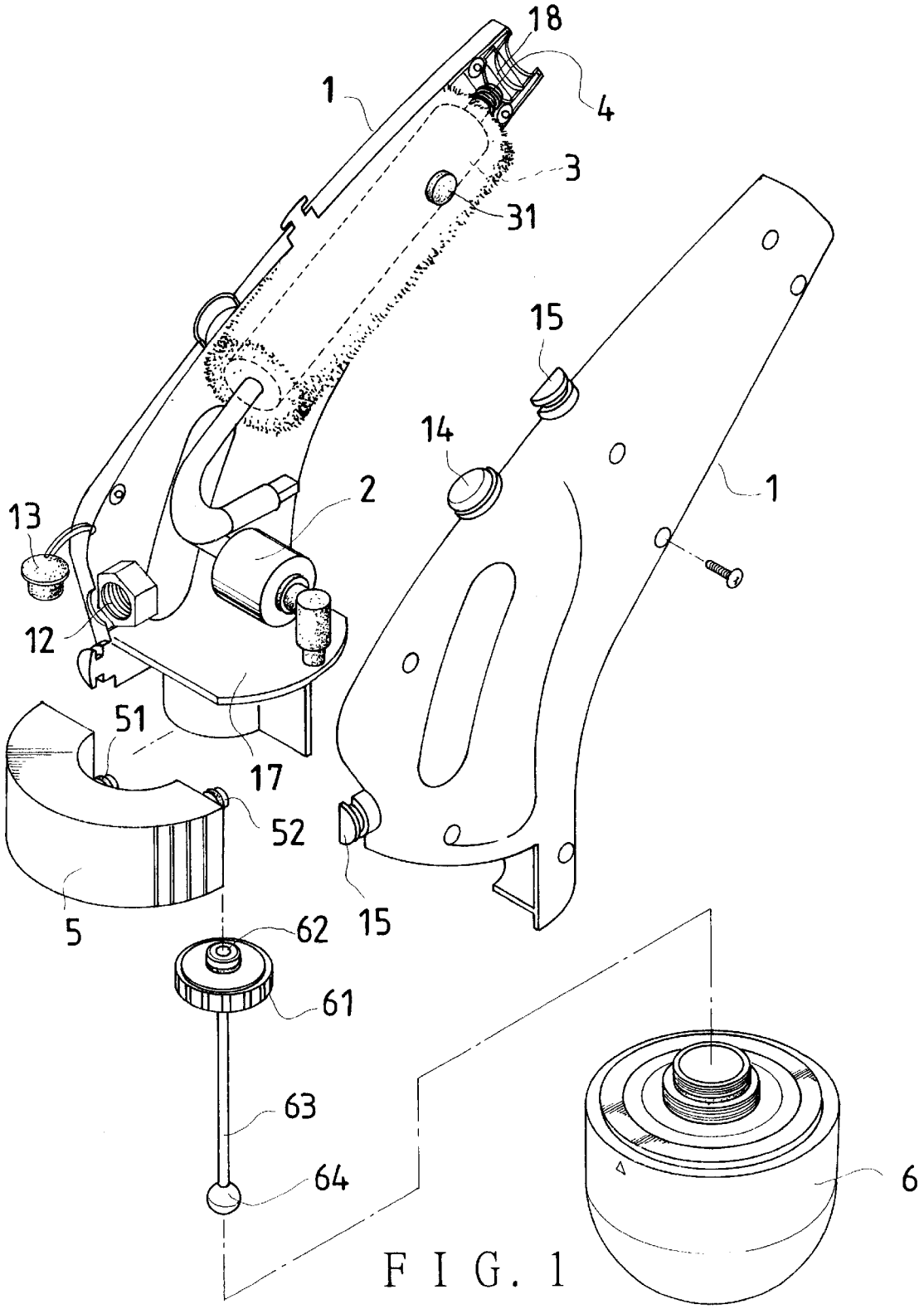
FIG. 1 is an exploded perspective view of the steam cleaner of the present invention.

Referring to FIG. 1, a steam cleaner of the present invention includes a housing member 1, a pump 2, an electric heater 3, a nozzle 4, a filtering member 5 and a water container 6.

The housing member 1 includes two half parts, and has a pair of securing projections 15 sticking up from middle portions of the top side thereof. A strap 16 (FIG. 7) is connected to the housing member 1 with two end positioning buttons 161 thereof being each connected to one of the securing projections 15. The housing member 1 has an engaging trench 18 on the inner side of an upper end portion, a switch 14 for starting and stopping the flow of electricity to both the pump 2 and the electric heater 3, a connecting hole 12, a plug 13, a handle 11 and a base part 17. The plug 13 is inserted into the connecting hole 12 when the steam cleaner is held by the user from the handle 11 of the housing member 1, and is removed for allowing a telescopic extension holding rod 7 to be connected to the hole 12 when the user wants to hold the steam cleaner by the extension rod 7 in cleaning.

Figure 2:
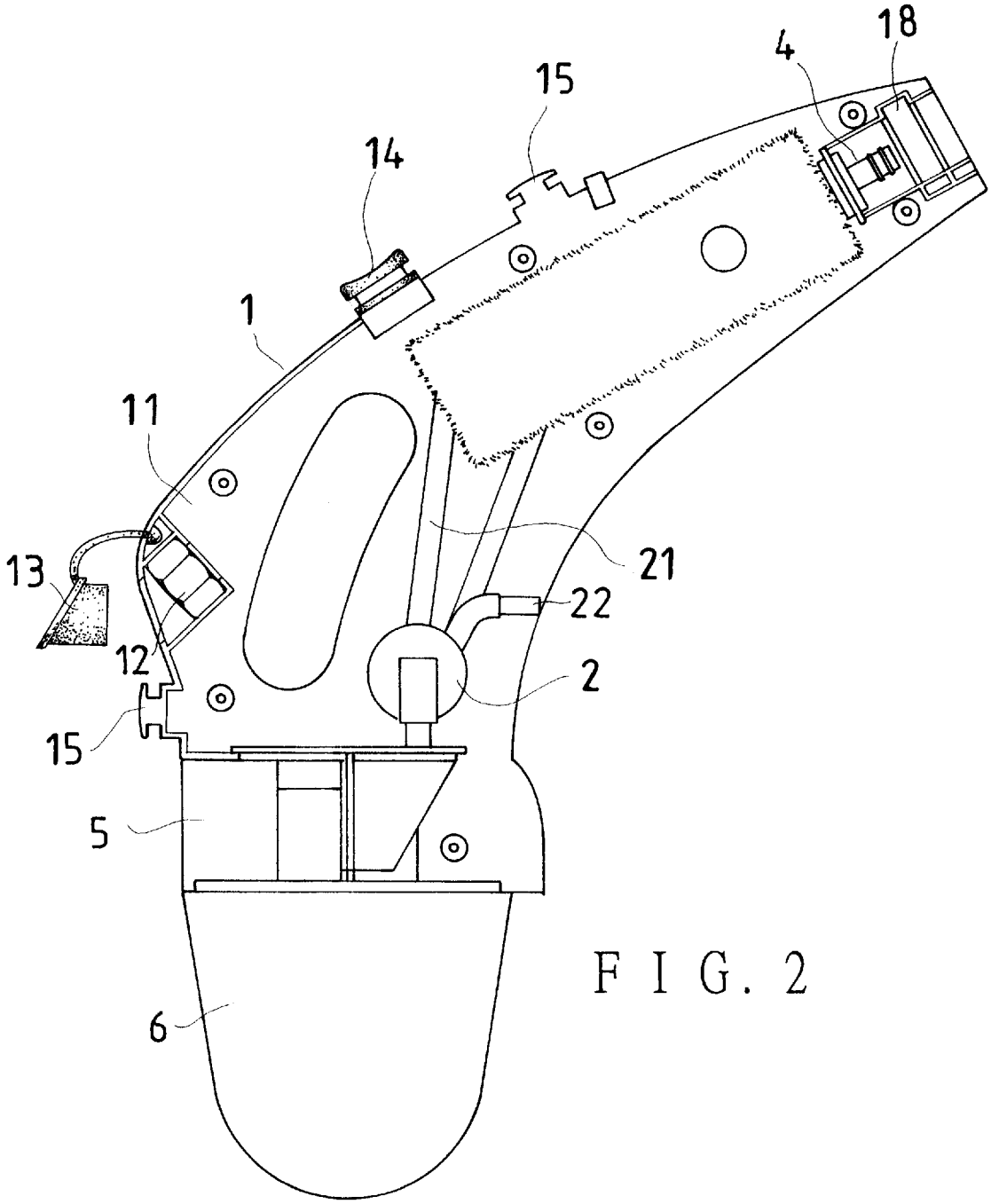
FIG. 2 is a plan view of the steam cleaner of the present invention.

The pump 2 and the electric heater 3 are received in the lower portion and the upper portion of the housing member 1 respectively. Referring to FIG. 2, the pump 2 has a drain switch 22, and a water pipe 21 connected to the outlet thereof and passed through the heater 3 to communicate with the upper end opening of the housing member 1; the drain switch 22 is provided for allowing the user to make water to flow away from the pump 2 in emergency such as blockage of the water pipe 21 or the nozzle 4, which is connected to the upper end of the pipe 21. The heater 3 is further provided with a safety switch 31, which can automatically cut off the heater when the heater overheats.

Figure 3:
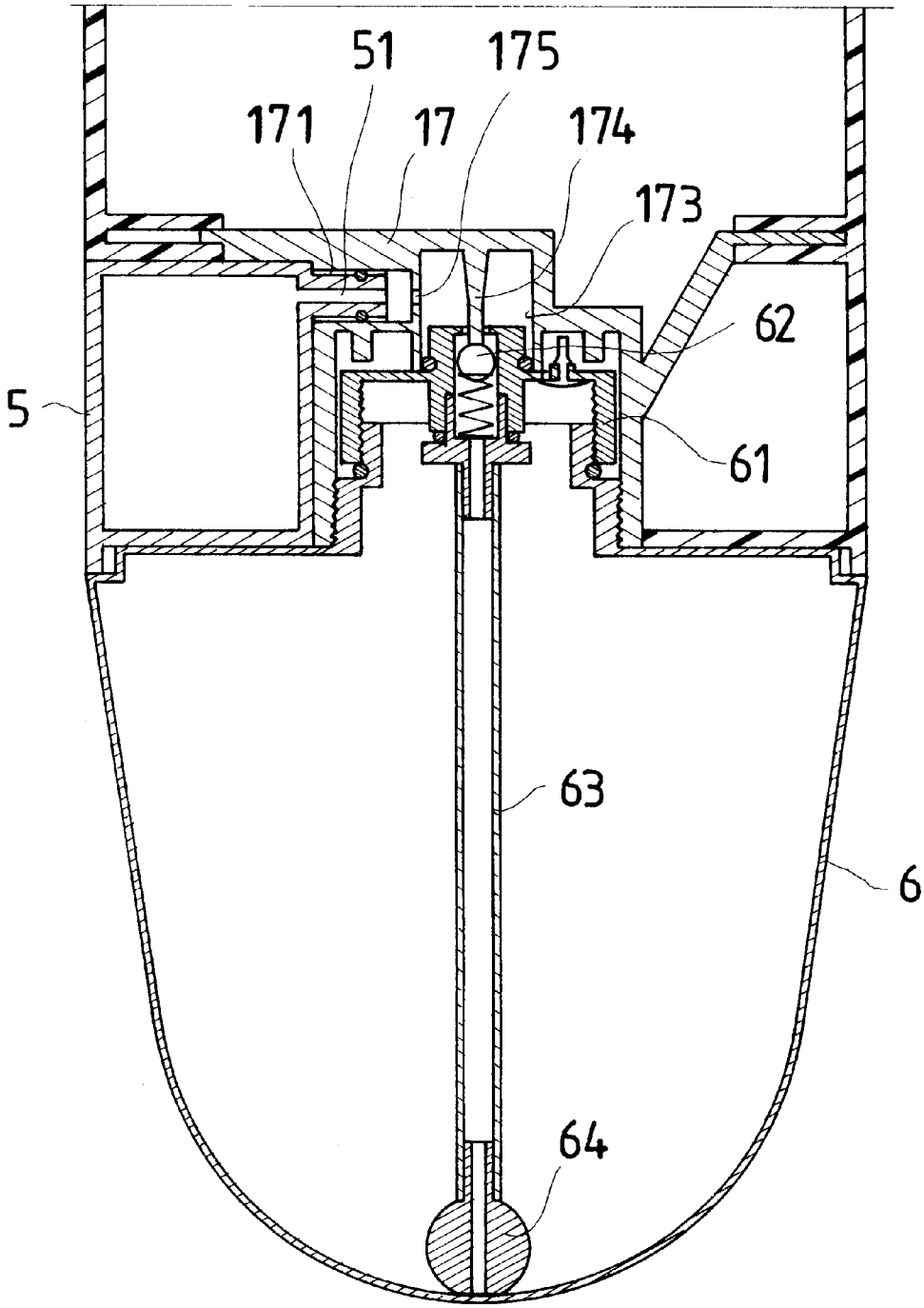
FIG. 3 is a sectional view of the lower portion of the cleaner in FIG. 1.

Referring to FIG. 3, the base part 17 is formed at the lower end of the housing member 1, and has connecting holes 171 and 172 (FIG. 4), a connecting part 173, a hole 175 formed on the lateral wall thereof for allowing the same to communicate with the connecting hole 171, and a depressing part 174 sticking down from the center of the connecting part 173. The water inlet (not numbered) of the pump 2 is connected to the connecting hole 172 of the base part 17.

Figure 4:
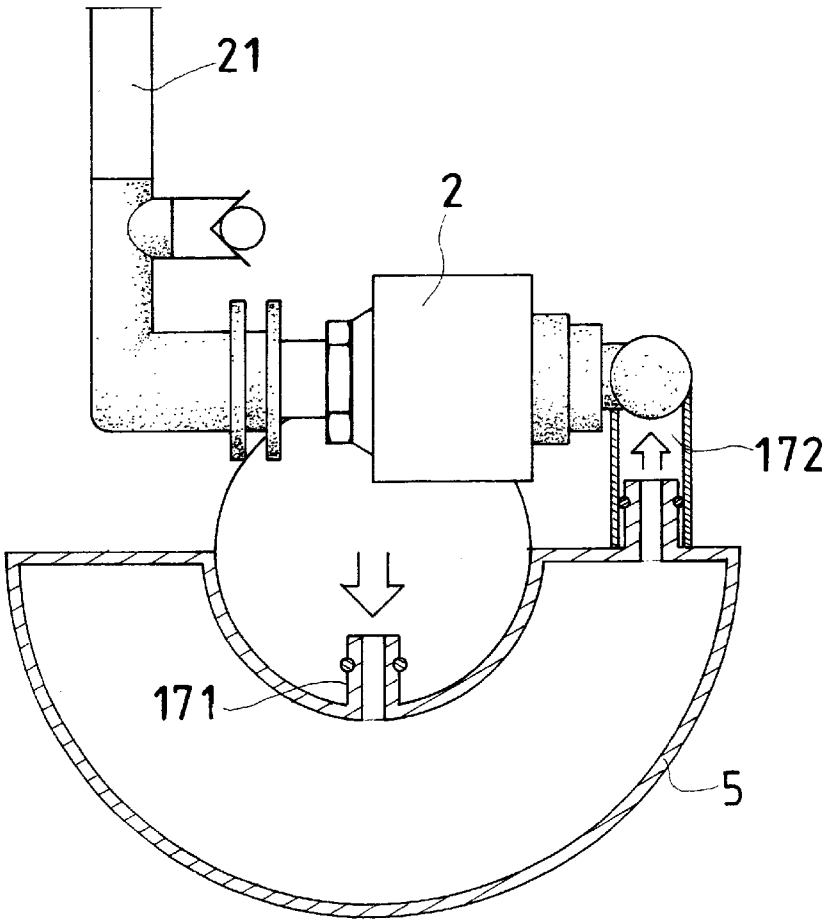
FIG. 4 is a fragmentary sectional view of the cleaner in FIG. 1.

Referring to FIGS. 1, 3 and 4, the filtering member 5 has an inlet 51 and an outlet 52; the filtering member 5 is connected to the base part 17 of the housing member 1 with the inlet 51 and the outlet 52 being connected to the connecting holes 171 and 172 respectively.

Referring to FIG. 3, the water container 6 includes a main containing body (not numbered), a cap 61 secured to a top opening of the main body, and a soft tube 63 received in the main body. The cap 61 has a central hole, and a depressable plug 62 biased up to block the central hole by a spring. The soft tube 63 is connected to the cap 61 from the upper end so as to communicate with the cap central hole, and connected to a weight 64 from the lower end; the weight 64 has holes communicating with the tube 63. Therefore, the weight 64 can be moved to such a position according to the movement and position of the housing member 1 as to assure the contact of the lower end of the soft tube 63 with the water in the container 6. When the container 6 is not fitted to the base part 17, the depressable plug 62 is biased up by the spring to block the cap central hole so as to prevent the water in the container 6 from flowing out. When the container 6 is screwed into the connecting part 173 from the upper end and the cap 61, the depressing part 174 of the base part 17 will pass through the cap central hole to depress the plug 62 such that water can flow through the cap central hole from the soft tube 63; the water flowing through the hole of the cap 61 will be forced through the hole 175, the inlet 51, the filtering member 5, the outlet 52, the connecting hole 172 of the base part 17, and the inlet of the pump 2 in sequence when the pump 2 is working. Thus, impurity of the water is removed by the filtering member 5, and forced into the water pipe 21 passing through the electric heater 3 to become steam; the steam is then sent out from the nozzle 4 and the upper end opening of the housing member 1.

In addition, the switch 14 can be made in such manners as to be used for controlling the pump 2 between a low-speed mode and a high-speed mode when it is pressed to activate the pump 2; the pump 2 pumps less water in the low-speed mode than in the high-speed mode, therefore, the user can decide on the amount of steam sent out from the cleaner.

Figure 6:
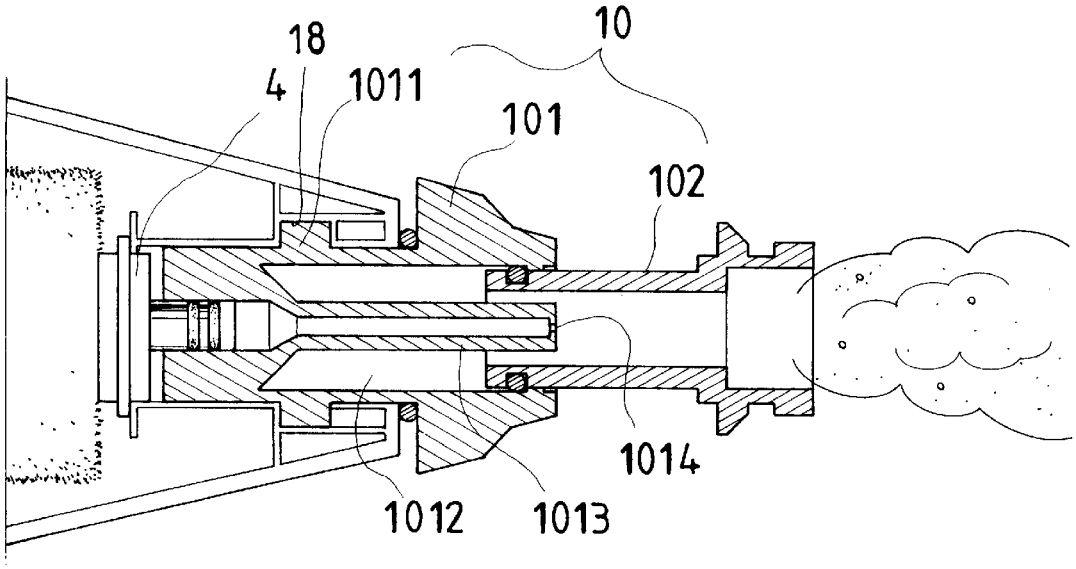
FIG. 6 is another sectional view of the cleaner front end in FIG. 5.
Figure 5:
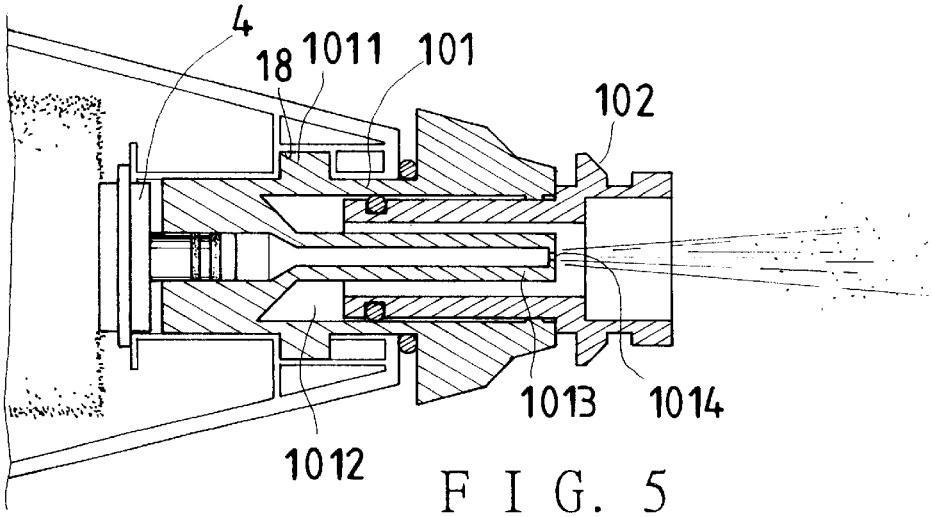
FIG. 5 is a sectional view of the front end of the cleaner according to the present invention.

Referring to FIGS. 5 and 6, a control head member 10 is fitted to the front end portion of the housing member 1, and includes an outer tube 101 and an inner tube 102. The outer tube 101 has engaging protrusions 1011 engaging the engaging trench 18 of the housing member 1, and has a hollow pole 1013 communicating with the nozzle 4, and an annular receiving room 1012 defined by both the outer wall and the pole 1013; said pole has a small hole 1014 at the front end. The inner tube 102 has an outer end opening (not numbered) larger than the other part thereof, and is movably passed into the outer tube 101 and around the hollow pole 1013; when the rear portion of the inner tube 102 is positioned in the outer tube 101, as shown in FIG. 5, the steam will be more concentrated when sent to outside via the small hole 1014, and when the inner tube 102 is moved to the frontmost position, as shown in FIG. 6, the stream will be more spread out when sent to outside.

Figure 7:
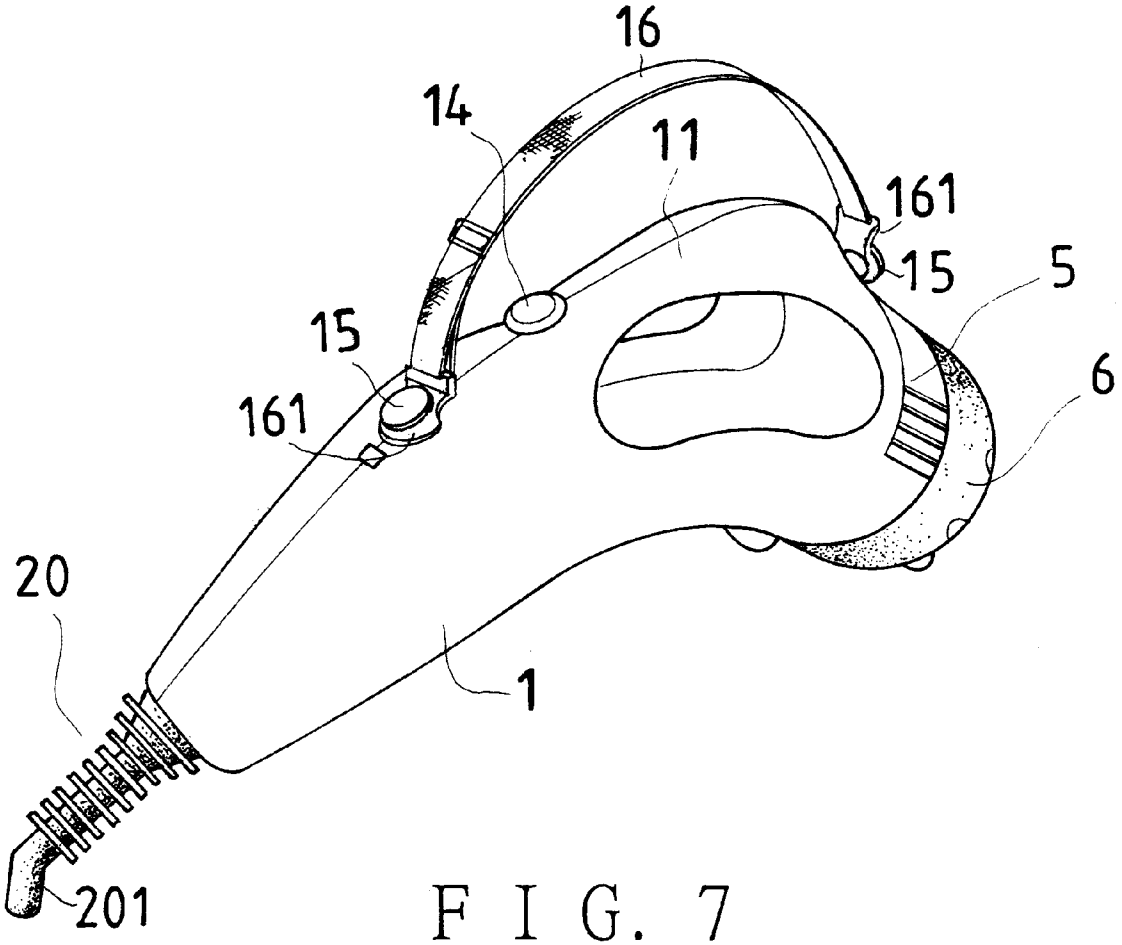
FIG. 7 is a perspective view of the cleaner according to the present invention.
Figure 8:
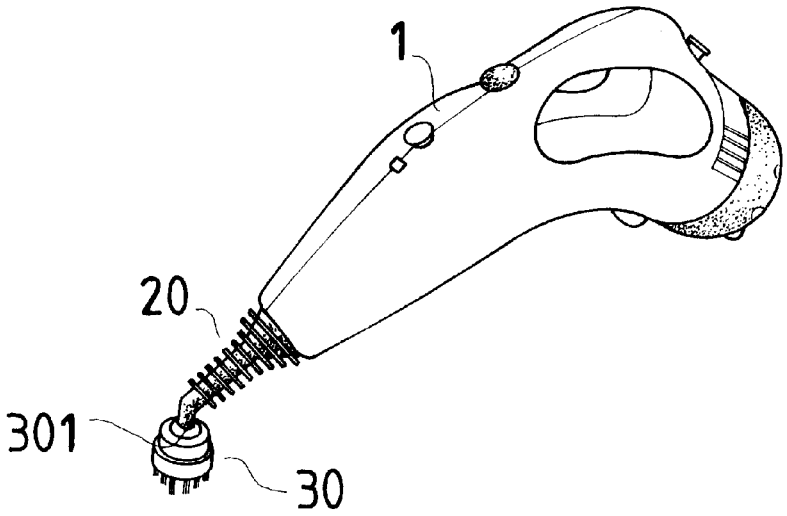
FIG. 8 is a perspective view of the cleaner with a second cleaning head.

Referring to FIG. 7, a head member 20 is connected to the front end opening of the housing member 1, and has a tube-shaped folded portion 201 at the front end so as to allow the steam cleaner to clean the narrow space of corners. Referring to FIG. 8, the folded portion 201 can be connected to a cleaning member 30; the connecting member 30 has a round main body, threads of thick string on the bottom of the main body, and a through hole 301, into which the folded portion 201 is passed.

Figure 9:
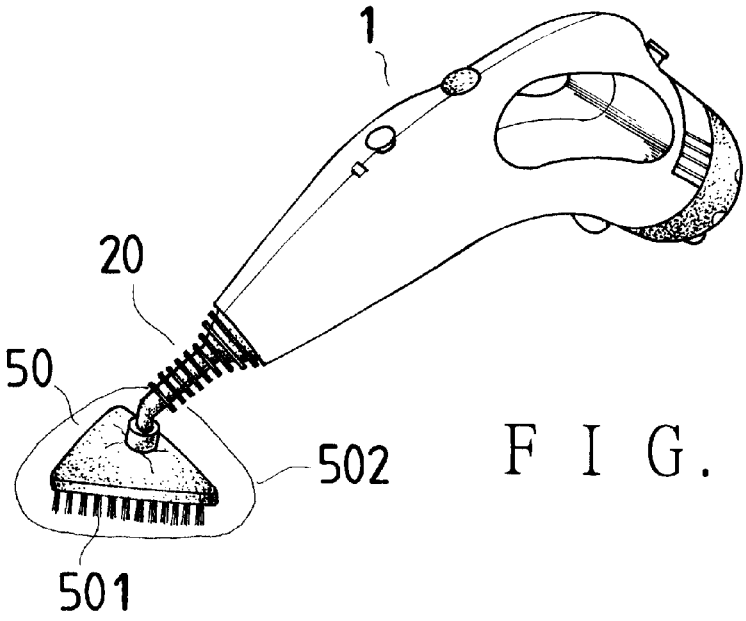
FIG. 9 is a perspective view of the cleaner with a third cleaning head.
Figure 10:
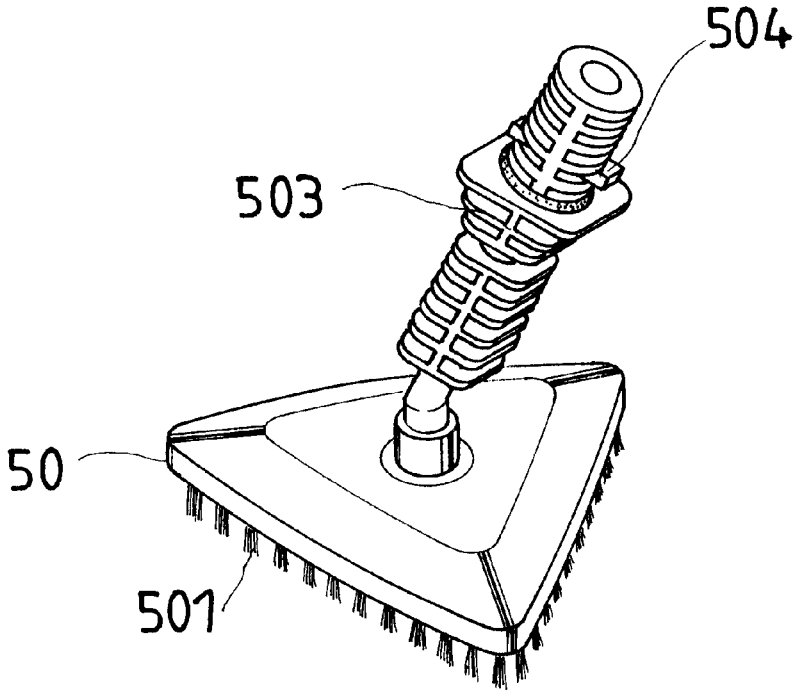
FIG. 10 is a view of the third cleaning head of FIG. 9.

Referring to FIG. 9, a cleaning member 50 includes a triangular main body connected to the folded portion 201, and threads of thick string 501 on the bottom of the main body. The cleaning member 50 is for cleaning objects with larger surfaces, and can be further provided with a cotton covering 502 for washing net-like objects such as screw windows and the protective nets of fans with. Referring to FIG. 10, the cleaning member 50 can be further provided with a connecting portion 503 on top of the main body thereof, and engaging protrusions 504 on the portion 503 such that it can be directly secured to the housing member 1 with the protrusions 504 engaging the engaging trench 18 of the housing member 1 instead of the head member 20.

Figure 12:
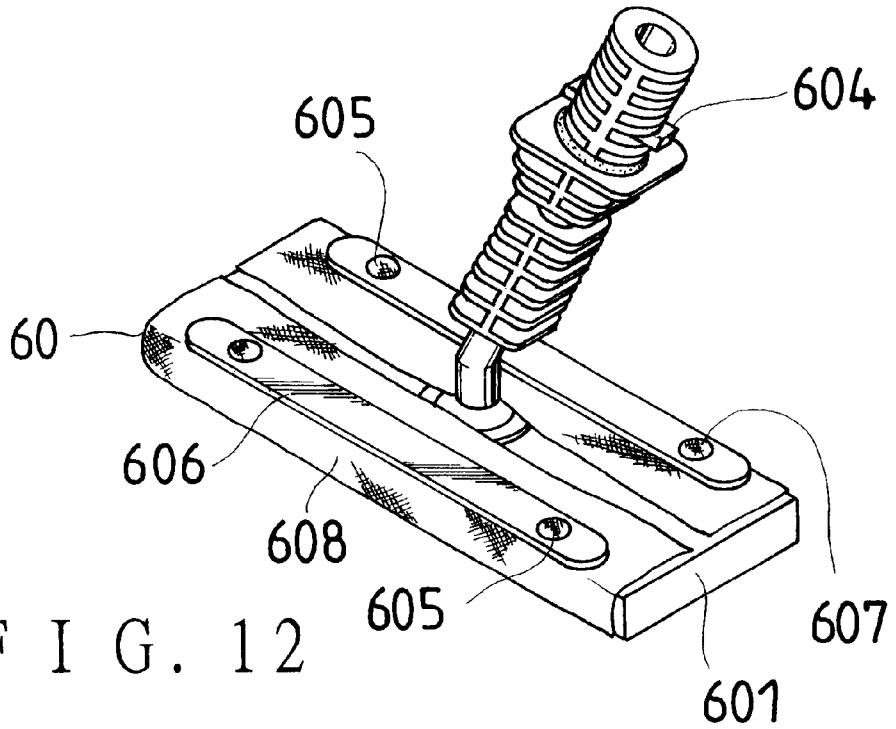
FIG. 12 is a view of the fourth cleaning head according to the present invention.
Figure 11:
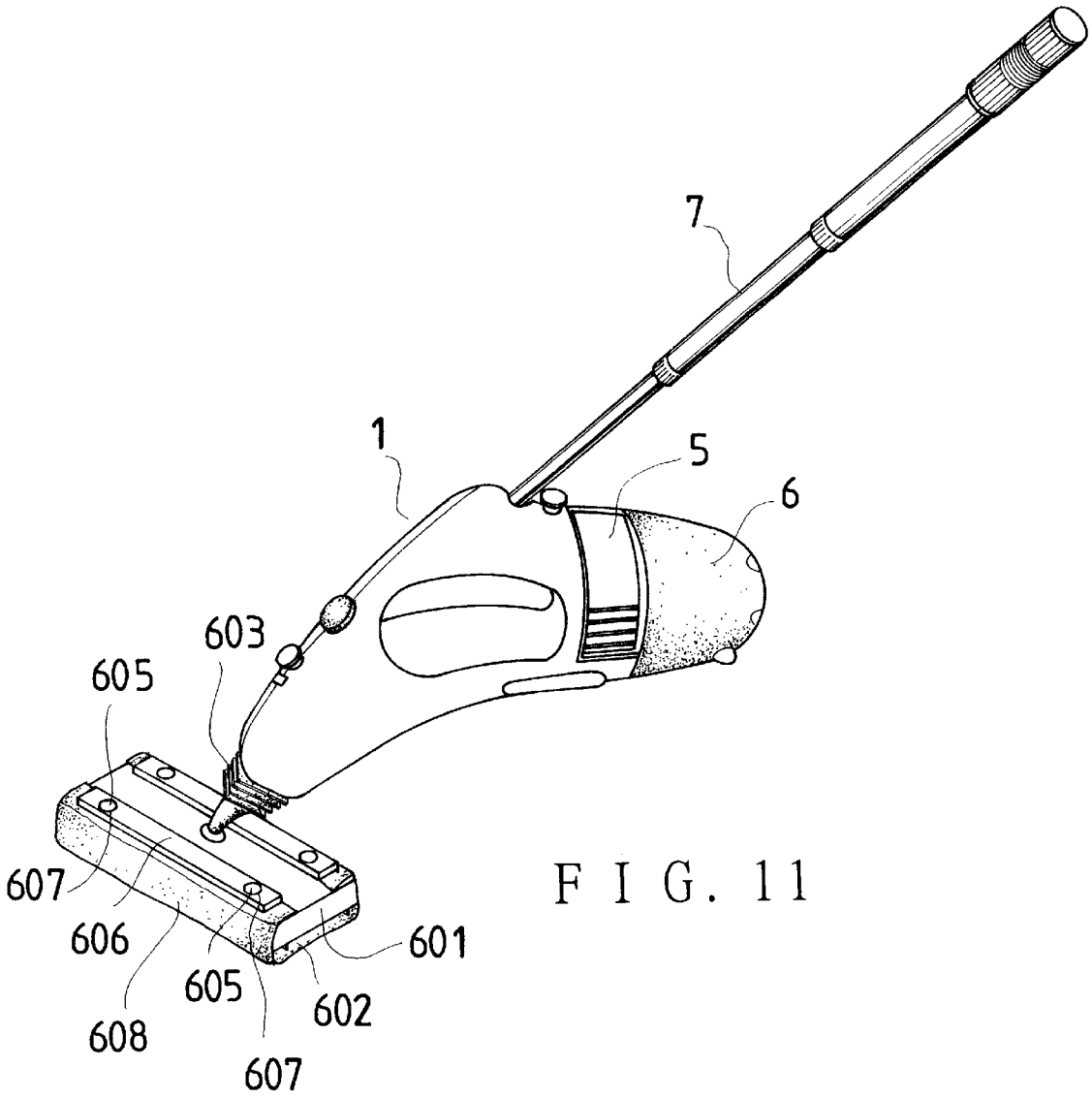
FIG. 11 is a perspective view of the cleaner of the present invention equipped with a fourth cleaning head and an extension holding rod.

Referring to FIGS. 11 and 12, a cleaning member 60 includes a rectangular main body 601, threads of thick string 602 on the bottom of the main body 601, a hollow connecting portion 603 connected to both the main body 601 and the upper end opening of the housing member 1; the connecting portion 603 has engaging protrusions 604, which are secured in the engaging trench 18 of the housing member 1. The main body 601 further has securing bumps 605 on the upper surface. A cotton cloth 608 is positioned over the securing bumps 605 and the threads of thick string 602, and secured in position by securing bars 606, which are connected to the main body 601 with holes 607 thereof tightly passing around the securing bumps 605. Thus, the cleaning member 60 can be rubbed against the ground like a conventional mop in cleaning when the extension rod 7 is secured to the housing member 1 as shown in FIG. 11.

For the head member 10, and the cleaning members 50 and 60, the engaging protrusions 1011, 504, 604 are first passed into the opening of the housing member 1, and then the members 10, 50 and 60 are turned to a proper position for the protrusions 1011, 504, 604 to be firmly received in the engaging trench 18.

The user can decide on a suitable one of the cleaning members to be fitted to the housing member 1 according to the needs. In using the steam cleaner, the steam will come out to kill the bacteria on the objects when the cleaning member fitted to the housing member 1 is rubbed against the objects.

Therefore, the steam cleaner can be known to have an advantage as compared with the conventional mops that it can kill bacteria with the steam, while rubbed against the object to be cleaned without the use of detergent, which is likely to harm the skin of the user and pollute the environment.

What is claimed is:

1. A steam cleaner, comprising a housing member having a handle, an upper end opening and a lower base part; said base part including a first connecting hole, a second connecting hole and a connecting part; said connecting part having a hole communicating with said first connecting hole;

an electric heater positioned in said housing member, said electric heater being electrically connected to a switch fitted on said housing member;

a nozzle connected to said upper end opening of said housing member;

a pump positioned in said housing member and electrically connected to said switch; said pump having an inlet connected to said second connecting hole of said base part and a water pipe connected to an outlet thereof; said water pipe being passed through said heater to communicate with said upper end opening;

a filtering member secured to said base part of said housing member; said filtering member having an inlet connected to said first connecting hole and an outlet connected to said second connecting hole;

a head member connected to said upper end opening of said housing member;

a water container secured to said connecting part of said base part from a top cap thereof, said cap having a hole for allowing water in said container to be forced through same, said hole of said connecting part, said inlet of said filtering member, said filtering member, said outlet of said filtering member, said inlet of said pump and said water pipe in sequence when said switch is pressed such as to activate both said pump and said heater;

whereby said water forced through said water pipe is heated to become steam by said electric heater and sent out via both said nozzle and said head member to help kill bacteria when said head member is rubbed against an object to clean said object.

2. The steam cleaner as claimed in claim 1, wherein said handle is formed on an upper surface of said housing member.

3. The steam cleaner as claimed in claim 1, wherein said housing member has a connecting hole having a plug removably fitted thereinto; a telescopic extension holding rod being able to be secured to said connecting hole for allowing a user to hold in cleaning when said plug is removed.

4. The steam cleaner as claimed in claim 3, wherein said head member includes a rectangular main body, threads of thick string secured to a bottom of said main body, and a hollow connecting portion connected to said main body from a lower end and to said upper end opening with engaging protrusion thereof being fixedly received in engaging trenches formed on an inner side of upper end of said housing members; a cotton cloth being positioned over said bottom thick threads and a plurality of bumps formed on an upper surface of said main body; securing bars being secured to said main body with holes thereof being mounted around said bumps so as to secure said cotton cloth in position for allowing said head member to be used as a mop.

5. The steam cleaner as claimed in claim 1, wherein said switch can be moved for controlling said pump between a low-speed mode and a high-speed mode when it is pressed so as to activate said pump.

6. The steam cleaner as claimed in claim 1, wherein said housing member is formed with two securing projections for allowing a strap to be secured to said housing member with end connecting holes of said strap being each connected to one of said securing projections.

7. The steam cleaner as claimed in claim 1, wherein said connecting part of said base part has a depressing part, and said water container has a depressable plug biased up to block said cap hole by a spring, and a soft tube secured to said cap from one end and connected to a weight at other end; said depressing part depressing said depressable plug inwardly of said cap for allowing said cap to communicate with said connecting part when said water container is connected to said connecting part; said weight moving according to a movement and position of said housing member such as to assure contact of said other end of said soft tube with said water in said container.

8. The steam cleaner as claimed in claim 1, wherein said head member includes an outer tube secured to said upper end opening and an inner tube; said inner tube being movably passed into said outer tube; said outer tube having an inner hollow hole with a front end hole communicating with said nozzle for said steam to be sent out therethrough; said inner tube having a front end opening larger than the other part thereof; said inner tube being slided along said outer tube so as to change a length of said head member for controlling a degree of said steam being spread out.

9. The steam cleaner as claimed in claim 1, wherein said head member has a tube-shaped folded portion at a front end for cleaning narrow space of corners with.

10. The steam cleaner as claimed in claim 1, wherein said head member includes a tube-shaped folded portion connected to said upper end opening at an upper end, and a round body connected to a lower end of said folded portion; said round body having threads of thick string secured to a bottom thereof.

11. The steam cleaner as claimed in claim 1, wherein said head member includes a connecting portion, a triangular main body connected to a lower end of said connecting portion, and threads of thick string secured to a bottom of said main body; said connecting portion being secured to said upper end opening of said housing member with engaging protrusion thereof being fixedly received in engaging trenches on an inner side of said upper end of said housing member.

12. The steam cleaner as claimed in claim 11, wherein a cotton covering is positioned around said triangular main body for allowing said head member to clean screen windows and protective nets of fans.

* * * * *